United States Patent [19]

Bowser

[11] 4,287,822

[45] Sep. 8, 1981

[54] TRUSS ASSEMBLY MACHINE

[75] Inventor: Donald M. Bowser, Barrie, Canada

[73] Assignee: Truswal Systems Corporation, Madison Heights, Mich.

[21] Appl. No.: 110,366

[22] Filed: Jan. 8, 1980

[51] Int. Cl.[3] ..... B30B 3/04

[52] U.S. Cl. ..... 100/35; 100/159; 100/173; 100/913; 29/432; 227/152

[58] Field of Search ..... 100/DIG. 13, 210, 35, 100/176, 159, 173; 29/798, 432; 269/321 F; 144/288 C, 246 R, 246 A, 246 G; 227/150, 152

[56] References Cited

U.S. PATENT DOCUMENTS

| | | | |
|---|---|---|---|
| 3,439,607 | 4/1969 | Sanford | 100/DIG. 13 |
| 3,785,277 | 1/1974 | Schmitt | 100/DIG. 13 |
| 3,855,917 | 12/1974 | Farrell et al. | 100/DIG. 13 |
| 3,903,583 | 9/1975 | Adams | 100/DIG. 13 |
| 3,908,259 | 9/1975 | Adams | 100/173 X |
| 4,089,107 | 5/1978 | Sanford | 100/DIG. 13 |

*Primary Examiner*—Peter Feldman

[57] ABSTRACT

A truss assembly apparatus for simultaneously rolling opposed toothed metal connector plates of V-webs onto both sides of vertically spaced horizontal wood chords. A prefabricated wood frame of such chords with end and intermediate spacers is fed between parallel vertical axis powered rollers with the V-webs manually applied to each side ahead of and as the frame is compressively driven through.

34 Claims, 16 Drawing Figures

TRUSS ASSEMBLY MACHINE

BACKGROUND OF THE INVENTION

Fabricated trusses of the type assembled on the present machine are disclosed in U.S. Pat. No. 4,078,352 and prior apparatus for assembling such trusses is disclosed in U.S. Pat. No. 4,002,116. The trusses comprise upper and lower wood chords which may be two by four or other rectangular shapes having end and intermediate wood spacers forming a preliminary truss frame. Metal V-webs, formed as sheet metal stampings having end and apex plates with vertical teeth struck therein and reinforcing ribs formed in the intermediate V-legs are pressed in opposed relation on either side of a pair of spaced wooden chords to form an elongated fabricated joist. The wood chords may be assembled in either flat or on edge relationship to each other utilizing the same V-web toothed metal plate connectors and in practice various chord sizes such as two by three, two by four, two by five and two by six have been employed with V-web connector heights such as 8", 9¼", 10¾" and 16".

The prior mechanical apparatus employed for assembling such fabricated truss joists comprised a pair of parallel rails upon which brackets were attached for supporting the chords above and along side each of the rails so that web connectors could first be laid upon the rails with teeth upwardly extending for embedding into the downward faces of the chords and upper webs could be aligned by laying them over the top faces of the chords to form a truss having aligned webs on opposite faces of the chords. A pair of clamping devices were movable along the rails for selectively clamping aligned pairs of connector portions on opposite chords against the wood embedding the teeth therein. Sequential movement of the clamping devices to pairs of connectors and clamping thereof involved intermittent step movement and clamping along the length of the joist limiting the speed of assembly to 2,000 linear feet per day with a three man crew compared with speeds in the order of ten times as great on the apparatus disclosed herein.

SUMMARY OF THE PRESENT INVENTION

An important feature of the present invention includes continuous rolling assembly of opposed V-webs on either side of vertically spaced chords passing between spaced parallel powered compression rollers. A pair of operators on either side of the assembly machine place a pair of V-webs onto a lower guide track and against either side of the vertically spaced upper and lower two by four or like chords just ahead of four vertically and laterally spaced opposed compression assembly rollers which continuously drive the upper and lower chords and compress the toothed connector plates of the metal V-webs into embedded assembled engagement with the chords as they pass through the rollers. Preferably the individual V-webs are placed with two lower leg extremities against a lower guide track with the lead leg in abutting engagement with the trailing leg of the next preceding V-web so that in assembled relation a continuous metal truss is formed interrupted however with intermediate spacing for transverse heat ducts or the like which may be readily provided to meet any architectural design requirements. Wooden truss frames with vertical end and intermediate spacers are preassembled and fed between a pair of vertical axis pinch rollers which drive the frame up to the point where the V-webs are manually applied against the sides just before entry between the compression rollers. Adjustability of both entry pinch rollers and compression assembly rollers is provided for on-edge or flat orientation of the upper and lower chords which may range in size from 2"×3" to 2"×6" as well as for vertical spacing which can range over any spacing height required such as 6" to 16".

In order to provide camber for the finished truss joist, so that the upper chord with dead load thereon will provide a horizontal surface when the lower chord is supported at its ends in a building structure, the truss is assembled upside down with entry and departure tracks on either side of the compression assembly rollers oriented in slightly sloping relation so as to impose required arching of the respective chord members as they pass through the assembly rollers which, with allowance for springback, will be retained in the finished truss joist.

Continuous feed speed in the potential range of up to 60 feet per minute is limited only by the rapidity with which the metal V-webs can be manually placed against the sides of the wood chords ahead of the compression rollers and practical speeds of at least 35 to 40 feet per minute are readily attained.

DETAILED DESCRIPTION OF THE PREFERRED EMBODIMENT

Figure 1:
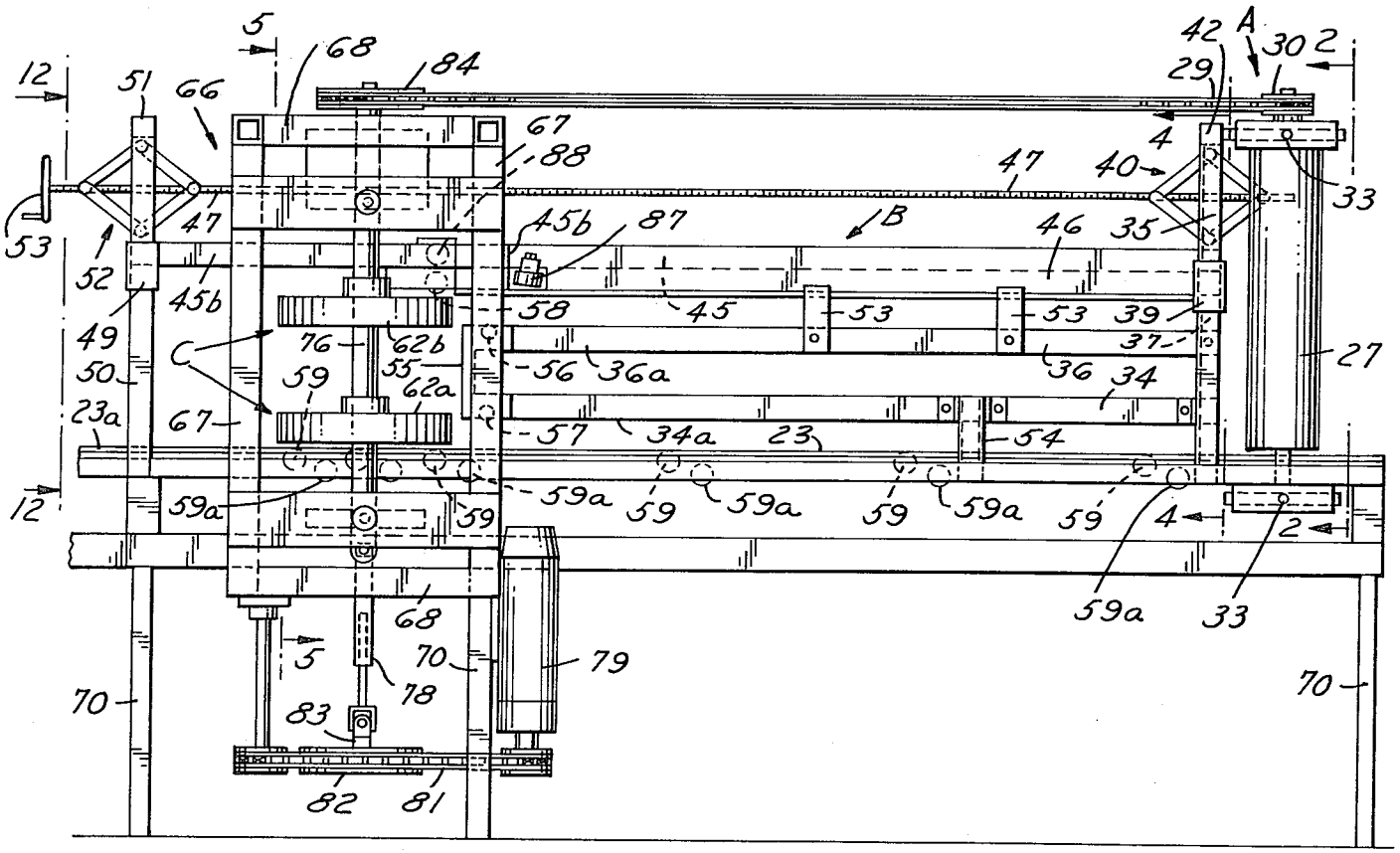
FIG. 1 is a fragmentary side elevation of a preferred embodiment of the truss assembly machine.

With reference to FIG. 1 the major components of the machine include a pair of entrance pinch rollers A, a track system B, two pairs of assembly rollers C and a roller drive D. In general the operation of the machine involves driving a wood truss frame comprising upper and lower two by four type chords preassembled with wood spacers between pinch rollers A along track system B where toothed metal V-webs are manually placed on either side ahead of the assembly rollers C through which the wood frame with applied V-webs are driven and compressively rolled into assembled engagement.

Figure 2:
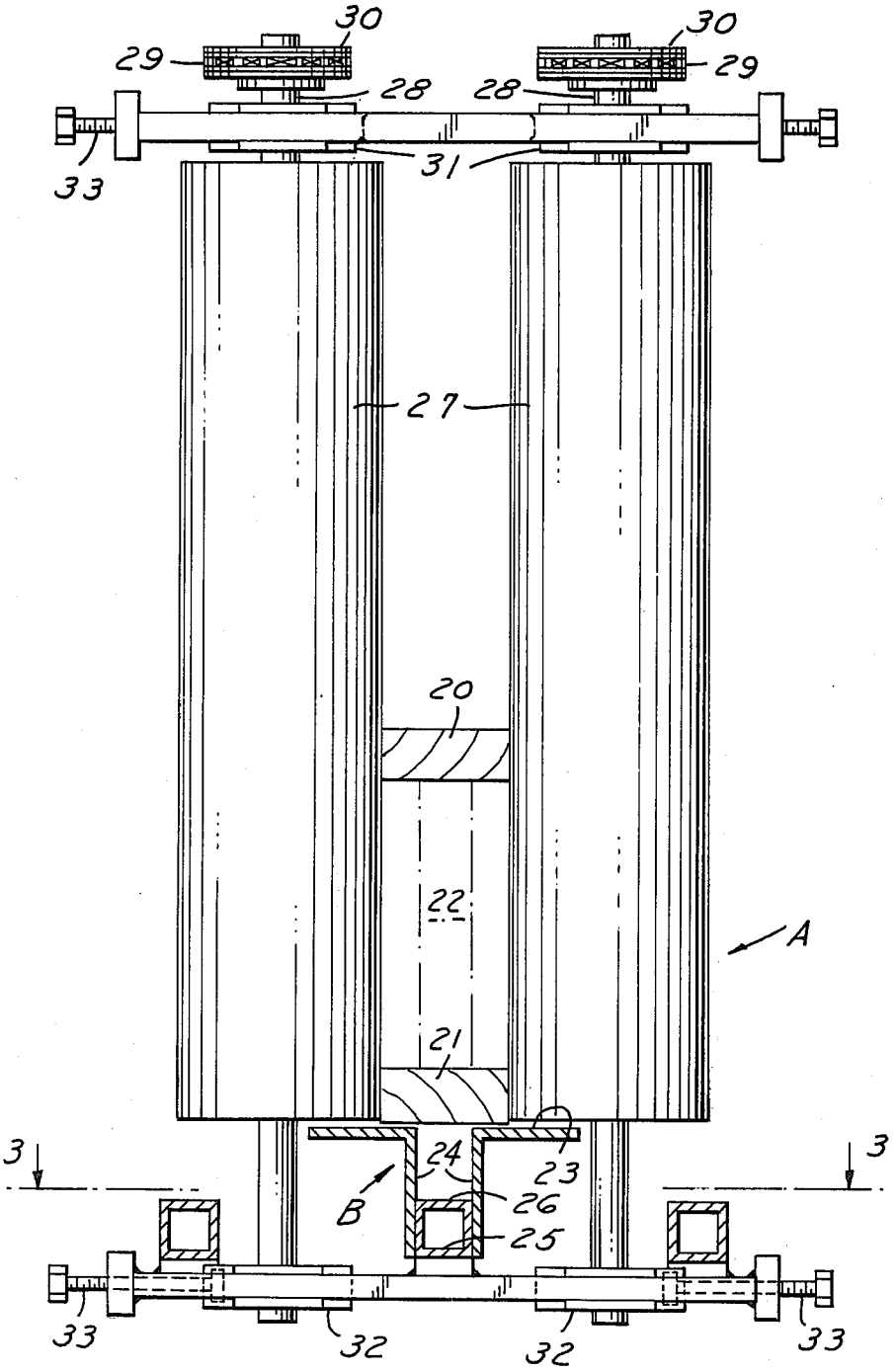
FIG. 2 is an enlarged sectional end elevation taken along the line 2—2 of FIG. 1.
Figure 11:
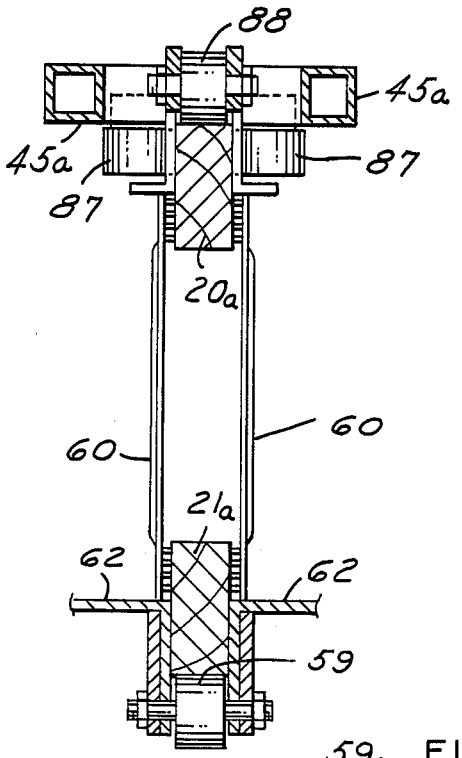
FIGS. 7, 8, 9 and 11 are sectional end elevations taken along the lines 7—7, 8—8, 9—9 and 11—11 of FIG. 6.
Figure 15:
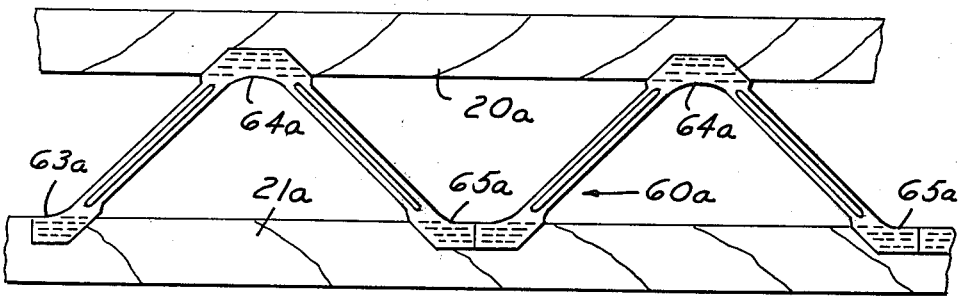

More specifically with reference to FIG. 2, a wood truss frame comprising upper and lower chords 20 and 21 joined by end and intermediate spacers 22 is supported in the case of the illustrated configuration on a series of anti-friction rollers 59 along the horizontal surfaces 23 of a pair of track angles 24 welded to an intermediate square tubular track member 25, the upper surface 26 of which serves as a track with projecting spaced rollers 59*a* for a lower chord oriented on edge as in the optional truss configuration shown in FIG. 15.

A pair of pinch rollers 27 mounted on vertical shafts 28 driven by chains 29 through sprockets 30 are adjustable through upper slides 31 and lower slides 32 positioned by adjustment screws 33 to a spacing for drivingly engaging the upper and lower chords 20 and 21 for whatever chord widths are being assembled.

Figure 4:
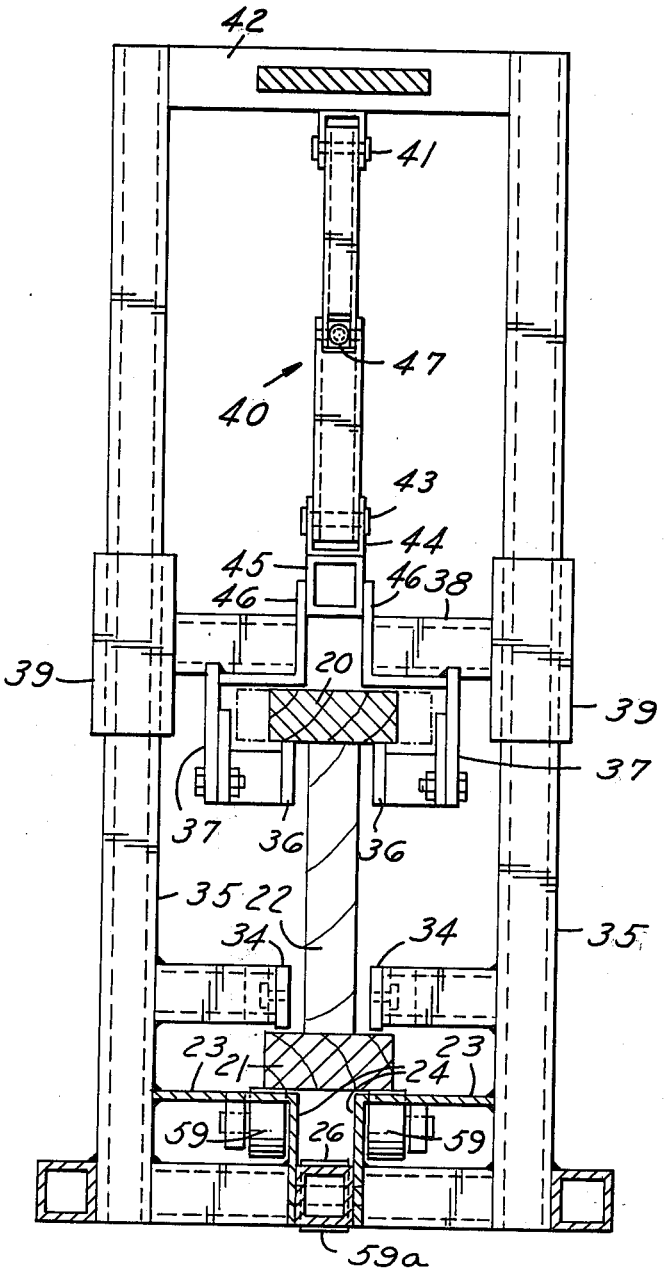
FIGS. 4 and 5 are enlarged sectional end elevations taken along the lines 4—4 and 5—5 of FIG. 1.

As shown in FIG. 4 after passing through the pinch rollers the lead end spacer 22 of the truss frame is guided between lower lateral extensions 34 secured to frame uprights 35 and upper lateral guide members 36, which also serve to support the upper chord from sagging between spacers 22, mounted on hangers 37 from an adjustable cross rail 38 having sleeves 39 slidable on the uprights 35. An adjustment hanger 40 pivotally suspended at 41 from an upper cross frame 42 and pivotally connected at 43 to a bracket 44 and horizontal square tube 45 and angle 46 beam structure serves through horizontally extending screw 47 to adjust the vertical position of the guides 36.

Figure 6:
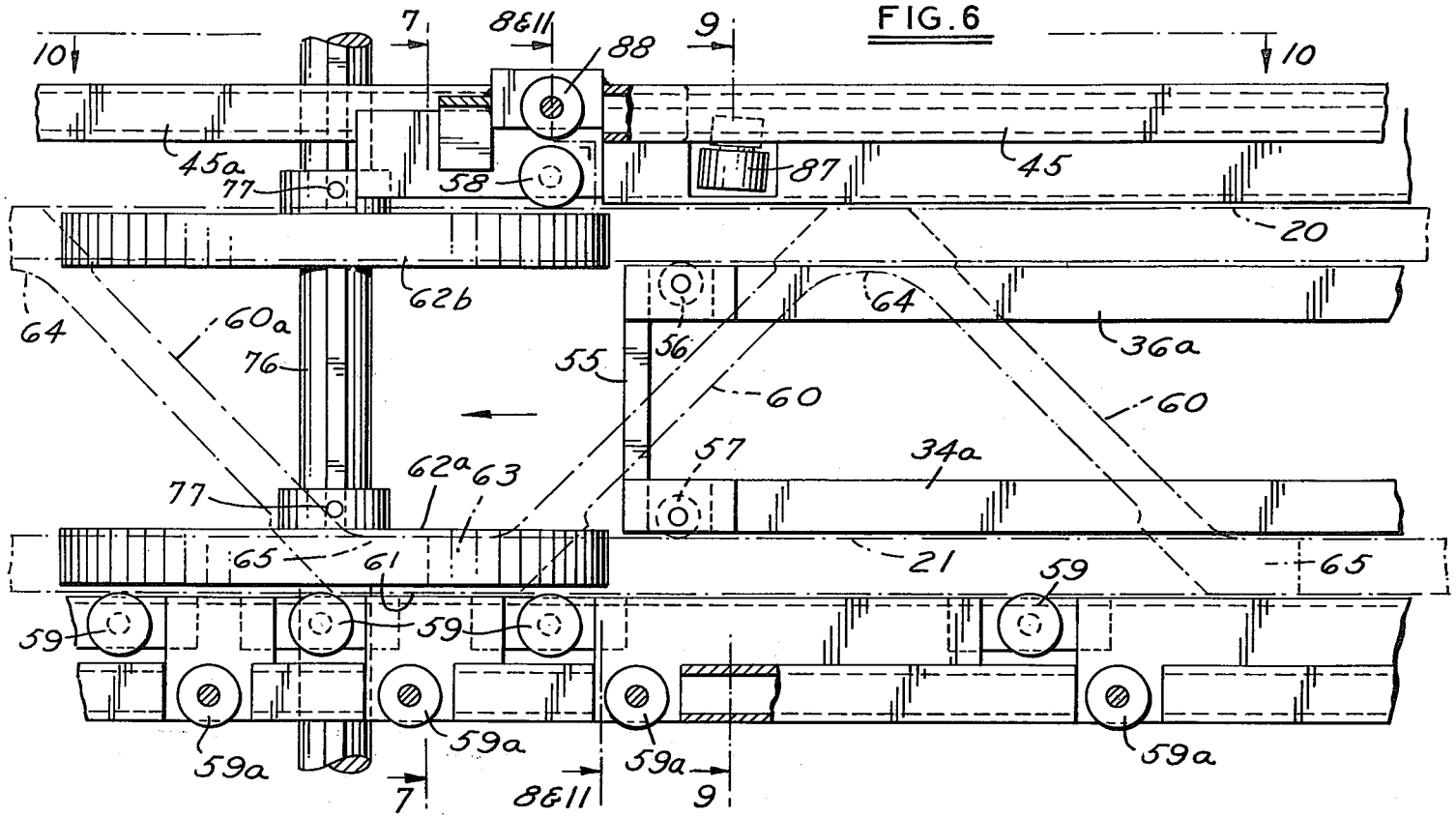
FIG. 6 is a further enlarged fragmentary sectional side elevation taken along the line 6—6 of FIG. 5.
Figure 7:
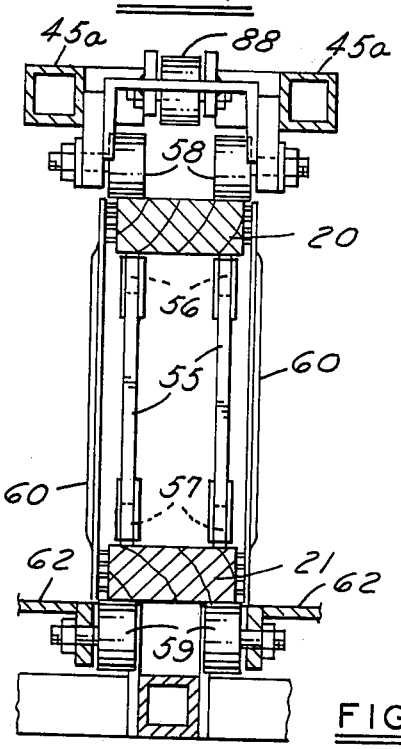
Figure 8:
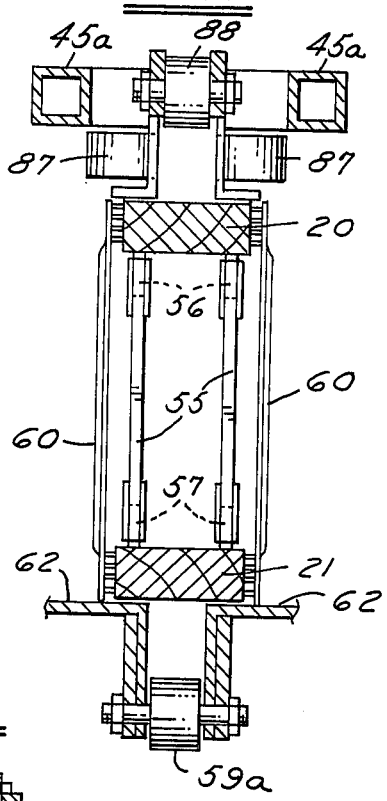
Figure 9:
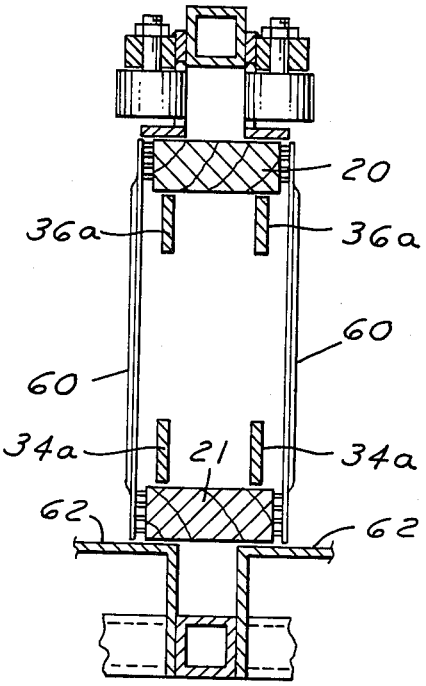

With reference to FIGS. 1, 6, 8, 9 and 12 the horizontal tube 45 branches at section line 8—8 to a pair of spaced tubes 45*a* which extend beyond roller assembly C to connections with transverse member 48 and sleeves 49 piloted on vertical frame members 50 having transverse support 51 for hanger 52 which is similar to hanger 40 and adjustable through horizontal screw 47 actuated by hand crank 53 so that beam assembly 45, 46 may be simultaneously adjusted at both ends along with guide track 36 suspended by bracket 53 secured to angle 46. Lower guide tracks 34 are also supported by brackets 54 and upper and lower extensions 36*a*, 34*a* of guides 36, 34 are connected at their outer ends by spacer bars 55 which position upper and lower inside rollers 56 and 57 mounted near the ends of the extensions 36*a* and 34*a* which with outside upper rollers 58 and lower rollers 59 mounted as shown in FIG. 7 serve to accurately size the spacing of upper and lower chords 20 and 21 immediately before entering between the compression assembly rollers C when assembled as shown with opposing flat sides.

V-web metal truss elements 60 manually placed against either side of the upper and lower chords with the lower leg extremities 61 engaging fixed lower guide tracks 62 are moved into abutting relationship with the trailing legs of the next preceding metal V-web 60*a* and manually held against the chords until compressively engaged by the respective lower assembly rollers 62 which will progressively compress the integral toothed leading connector plates 63, apex connector plates 64 and trailing connecting plates 65 of the opposed metal V-webs into embedded assembled engagement with the respective upper and lower chords.

Figure 3:
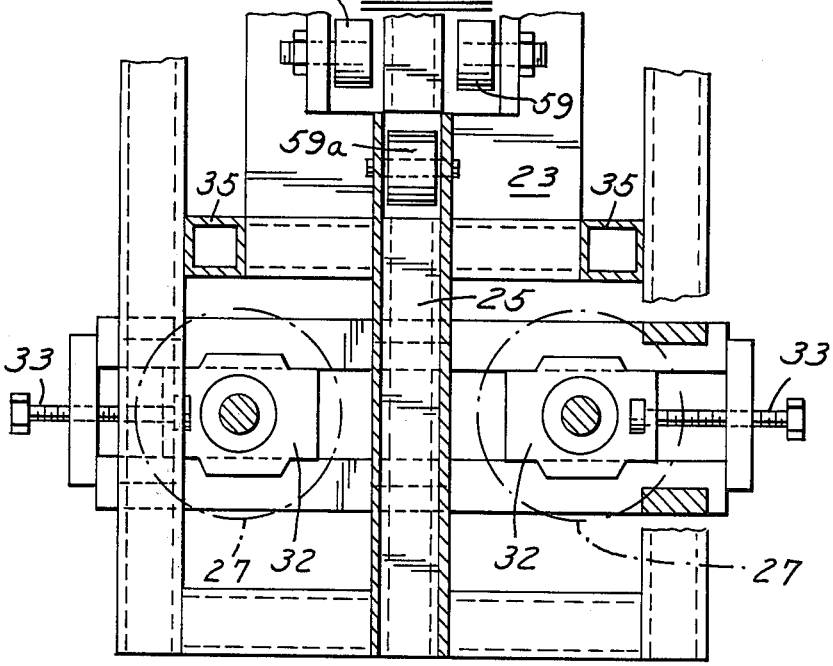
FIG. 3 is a sectional plan view taken along the line 3—3 of FIG. 2.
Figure 5:
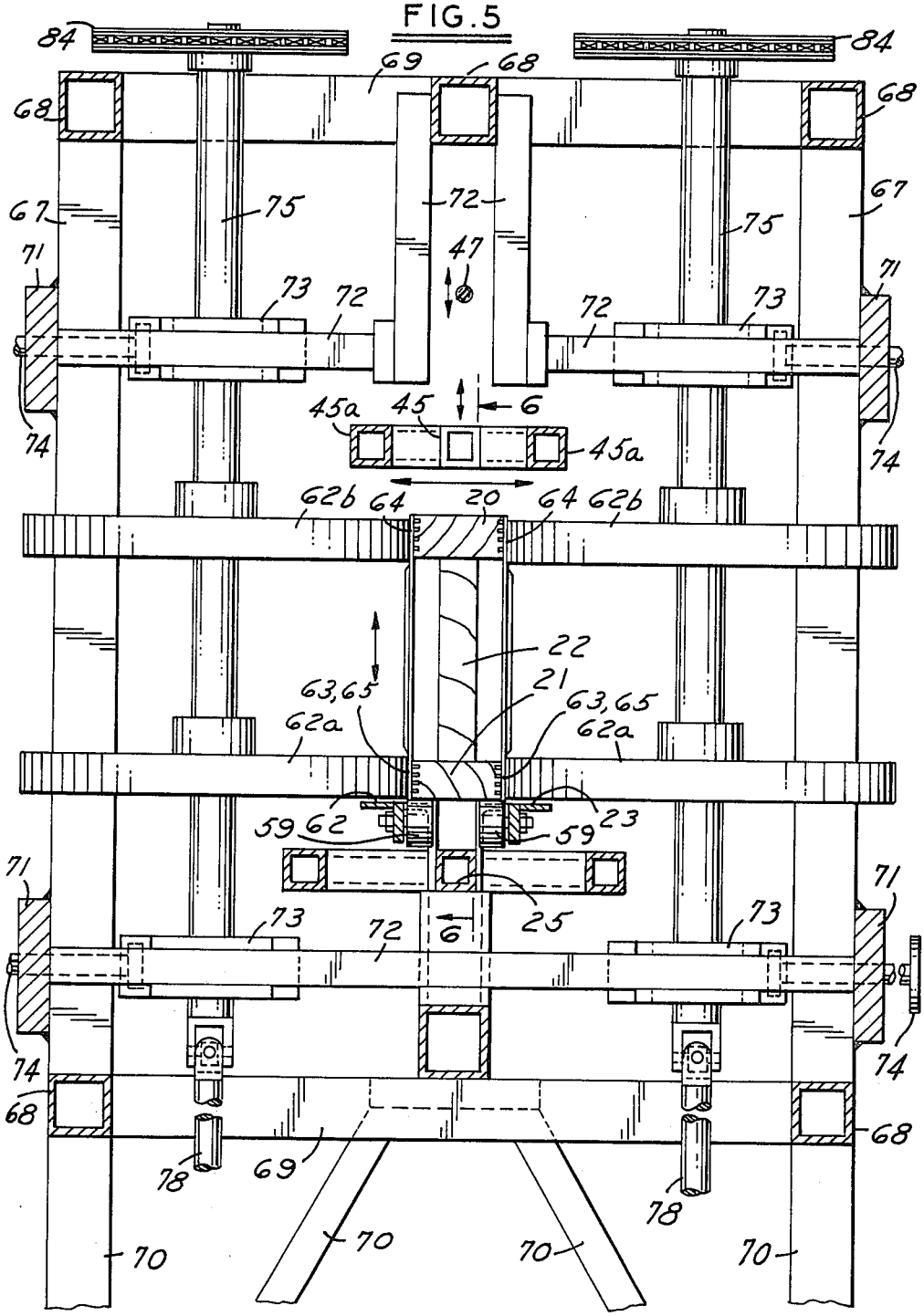

With reference to FIGS. 1 and 5 box frame generally indicated as 66 comprising respectively vertical, longitudinal and transverse frame members 67, 68 and 69 supported on floor legs 70 mounts longitudinal bars 71 and transverse bars 72 on which adjustable journals 73 similar to those illustrated in FIG. 3 are actuated through adjustment screws 74 and vary the position of drive shafts 75 for the lower and upper rollers 62*a* and 62*b* to a proper spacing for engaging the respective chords 21 and 20 and metal V-web connector plates 63, 64 and 65. In practice the rollers are set at a spacing of approximately 1/16" less than the width of the chords to assure compressive drive during engagement between metal connector plates, the additional 0.040" thickness of each of the connector plates being additionally absorbed by compression of the wood and assuring complete penetration of the integral teeth extending at right angles from the connector plates.

Drive keys 76 provided in shafts 75 for slotted engagement by lower rollers 62*a* and upper rollers 62*b*, the latter being readily adjustable in vertical height for different size trusses upon release of set screws 77.

Figure 13:
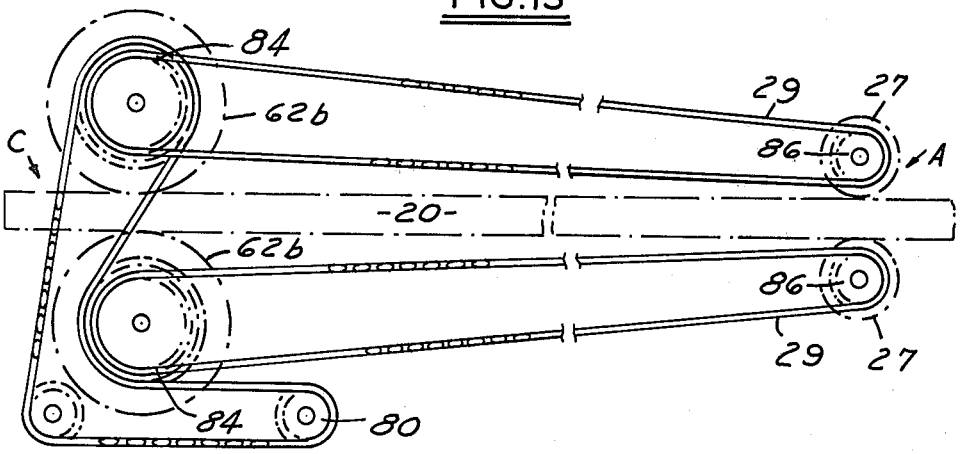
FIG. 13 is a schematic plan view of the chain drive shown in side elevation in FIG. 1.

Oppositely rotating drives are imparted to the drive shaft 75 through universal joint and shaft connections 78 driven by motor 79 through sprocket 80, chain 81, sprockets 82 and couplings 83 as shown in FIG. 1 and the schematic plan view of the drive in FIG. 13. Synchronized drives are imparted to the entrance pinch rollers 27 by power takeoff sprockets 84 at the top of the machine, longitudinal chains 85 and sprockets 86 connected to drive shafts for the pinch rollers 27.

Figure 14:
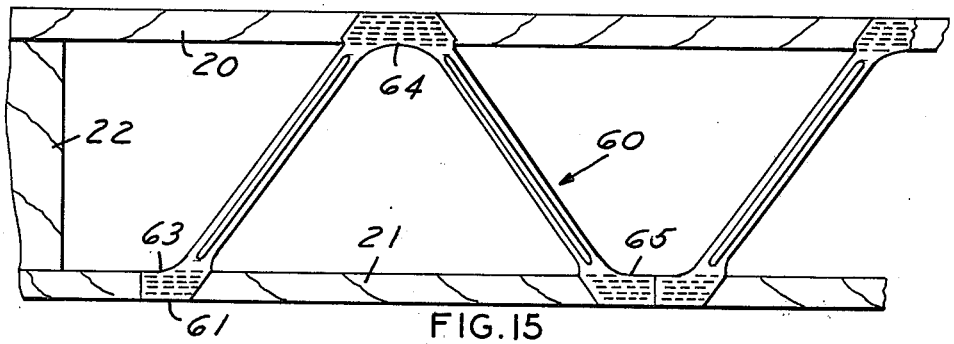
FIGS. 14, 15 and 16 are fragmentary side elevations of assembled truss joists indicating several size and chord configurations which can be assembled on the illustrated machine.
Figure 16:
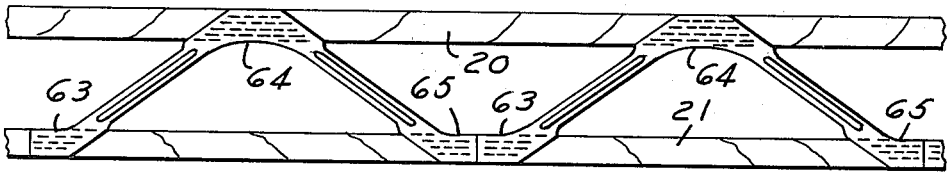

With reference to FIGS. 14, 15 and 16 illustrations of typical different truss sizes and chord orientation are shown which may be accommodated through simple adjustments of the machine which can be effected in approximately 10 to 15 minutes. In the illustrated machine standard chord sizes of 2"×3", 2"×4", 2"×5" and 2"×6" can be accommodated either on edge or flat with connector V vertical sizes ranging between 6 to 16 inches. Currently produced sizes of 8", 9¼", 10¾" and 16" are available and new sizes of 6", 7¼" and 14" are contemplated.

The machine thus far has been described with reference to a typical 10¾" truss with 2"×4" chords in opposed flat relation. Reviewing the sequence of operation, a prenailed frame comprising upper and lower chords 20 and 21 having end and intermediate spacers 22 enter the machine through pinch rollers 27 as shown in FIG. 2 traveling along the rollers in track surface 23 through lateral track guides 34 and 36. As best shown in FIGS. 6 and 7 rollers 56 and 57 accurately spaced by gauge bars 55 establish final inside sizing while upper and lower outer rollers 58 and 59 positively engage the outer chord surfaces and control the chord spacing and positioning as fed between the assembly compression rollers 62*a* and 62*b*. Metal V-webs 60 manually placed on either side with a leading lower leg plate 63 at the lead end of the truss are held until engaged by the lower rollers 62*a* whereupon they are driven continuously through the compression rolls into assembled relation. Successive V-webs are manually placed against the chords and moved forwardly into abutting relationship with the V-legs of the preceding V-webs until such time as an intermediate opening may be programmed, as to accommodate transverse duct passage, whereupon assembly resumes as described.

Desired camber is automatically imparted to the finished truss by providing a slight rising ramp angle on the assembled joist receiving tracks 23*a* which cooperate with the sizing rollers to effect an arching of the chords as assembled in an upside down condition relative to their use as joists supported at their ends.

In order to effect a change in vertical height for a new run of joists it is only necessary to change the level of upper track 45, inserting corresponding different gauge bars 55, and to change the level of the upper compression rollers 62b to a corresponding level. In order to effect change for different widths of chords 20 and 21 it is only necessary to adjust the spacing of pinch rollers 27 and the upper and lower compression rollers 62b and 62a.

Figure 10:
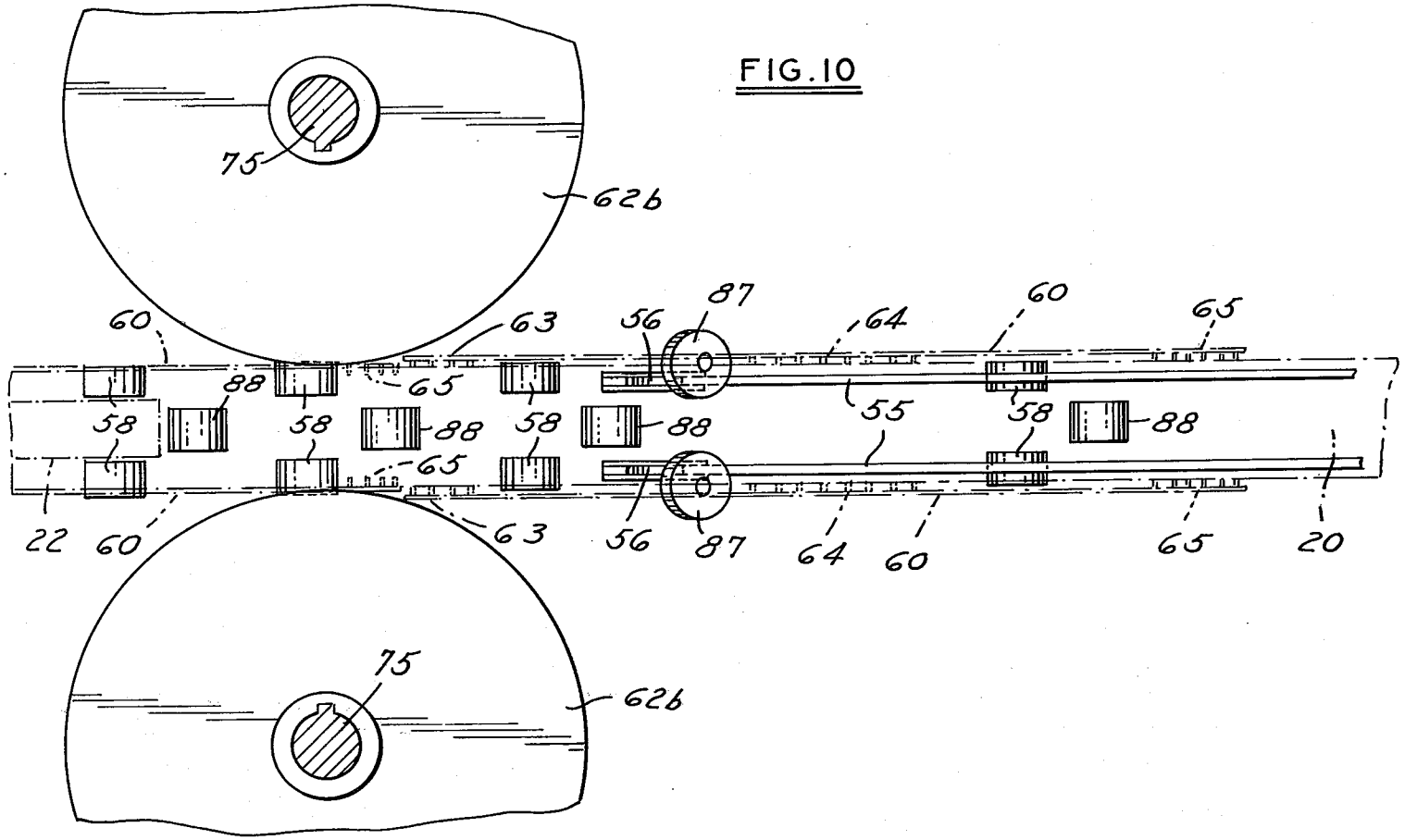
FIG. 10 is a semi-diagrammatic plan view taken along the line 10—10 of FIG. 6 omitting structural parts for clarity.
Figure 12:
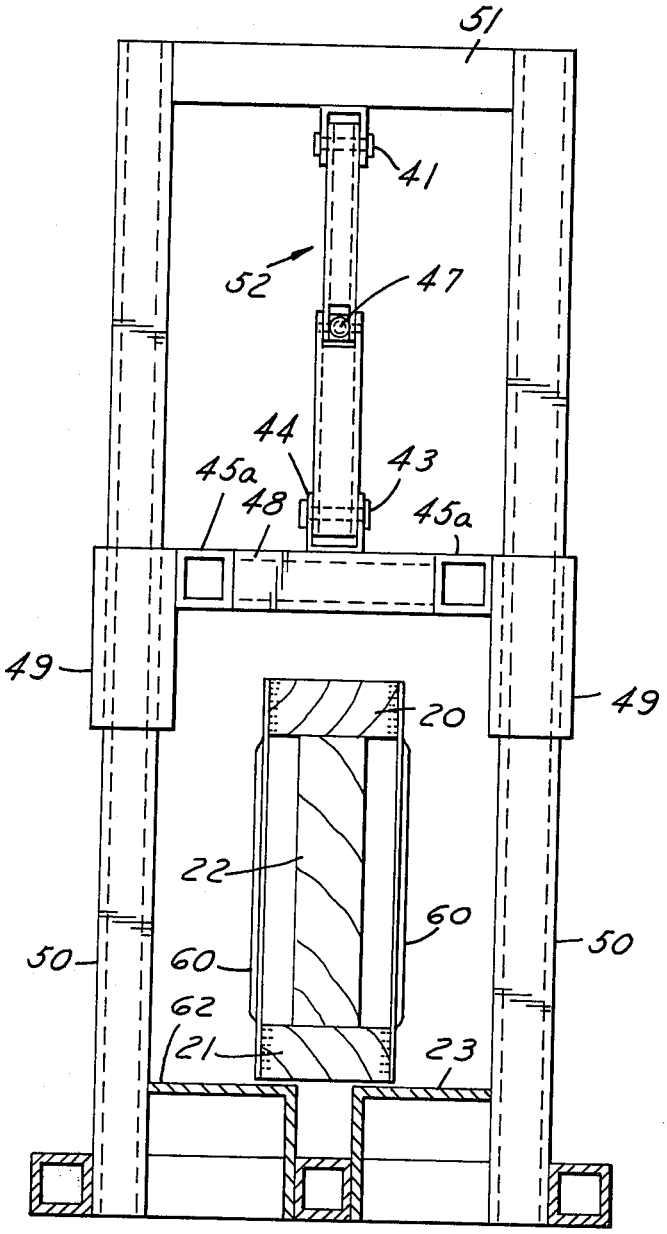
FIG. 12 is an enlarged sectional end elevation taken along the line 12—12 of FIG. 1.

In assembling the trusses with chords on edge the lateral track guides 34 and 36 are not required since the extension of the lower chord 21a below the connector plates 63a and 65a as shown in FIG. 15 is accommodated by the trough formed between the angle surfaces 24 and above the tubular track 26 while the extension of the upper chord 20a above the connector plate apexes 64a is accommodated by the space between the upper angle track members 46 as will be apparent from an examination of FIG. 4. Accordingly, in fabricating trusses with chords on edge the guide tracks 34 and 36 are removed and stored. In the absence of internal sizing by gauge bar 55 and rollers 56 and 57 as shown in FIG. 6, provision is made through the use of canted rollers 87 adapted to engage the upper chord 20a above the level of the connector plate to drive the chord upwardly against the roller 88 in order to effect sizing control of such upper chord. (FIG. 10 schematically illustrates in a plan semidiagrammatic view, with structural parts removed for clear viewing, the arrangement of size control rollers at the upper level.) To adjust for different heights of chord on edge trusses it is only necessary to adjust the level of the upper track through hand wheel 53 and the upper compression rolls 62b.

Due to the continuous rolling feature of this machine the speed of assembly is virtually limited only by the rapidity with which V-webs can be placed against the chord elements by operators on either side. Theoretical speeds in the range of 33 to 60 feet per minute are possible while speeds of 35 to 40 feet per minute with the four man crew are readily obtainable, even with the shorter pitch V-webs. Thus, an order of magnitude improvement in speed of assembly has been accomplished compared with prior art apparatus in current commercial use. Furthermore, reduction in set up time in changing from one size to another has been reduced from 45 minutes to approximately 10 minutes.

While the foregoing disclosure of the preferred embodiment involves metal V-webs, it will be understood that the same equipment can be adapted to various forms of connecting web elements such as W-webs, or simple diagonal metal braces having struck out tooth ends for connecting upper and lower horizontal wood chords to adjacent vertical wood spacers, in which case the wood spacers are pre-assembled and the diagonal braces are manually placed in connecting relation ahead of the assembly compression rollers as in the case of the V-webs. Similarly, individual diagonal tooth ended brace elements may be inserted at selective locations next to one of the legs of a V-web to give double strength reinforcement where required, the adjacent V-webs being spaced to accommodate accordingly.

As previously mentioned, the assembly machine can be run continuously at a speed appropriate to manual placement of the V-webs and provision is made for stopping and reversing the drive motor to remedy any misplacement of one of the webs or to effect any other correction which may be required at an intermediate location in the truss.

I claim:

1. Truss assembly apparatus for securing toothed connector plates to sides of vertically spaced wood chords comprising vertical axis longitudinally fixed roller means for progressively pressing said connector plates with teeth placed against said chords ahead of said roller means into wood penetrating assembled relation as they pass said roller means, means for maintaining said chords in required spaced relation, and means for driving said chords in said required spaced relation together with said connector plates past said side roller means.

2. Truss assembly apparatus as set forth in claim 1 in which said side roller means includes opposed roller means for simultaneously pressing said connector plates placed against one or both sides of said chords ahead of said roller means.

3. Truss assembly apparatus as set forth in claim 2 including means for adjusting said side roller means to accommodate different widths of chords.

4. Truss assembly apparatus as set forth in claim 2 including means for adjusting said side roller means to accommodate different spacing of chords.

5. Truss assembly apparatus as set forth in claim 2 including means for adjusting said side roller means both to accommodate different widths of chords and different spacing of chords.

6. Truss assembly apparatus as set forth in claim 2 including means for assembling rectangular chords with their major dimension in the plane of said truss.

7. Truss assembly apparatus as set forth in claim 2 including means for assembling rectangular chords with their minimum dimension in the plane of said truss.

8. Truss assembly apparatus as set forth in claim 2 including alternative means for assembling rectangular chords with either major or minor dimension in the plane of the truss.

9. Truss assembly apparatus as set forth in any of claims 1–8 including auxiliary roller means ahead of said side roller means and ahead of the location for placing said connector plates against said chords for driving said chords into engagement with said side roller means.

10. Truss assembly apparatus as set forth in claim 2 wherein said means for driving comprises drive means for both of said side roller means.

11. Truss assembly apparatus as set forth in claim 9 including drive means for said side roller means and synchronized drive means for said auxiliary roller means.

12. Truss assembly apparatus as set forth in claim 10 including means for adjusting the spacing of said side roller means.

13. Truss assembly apparatus as set forth in claim 10 including means for adjusting the spacing of said side roller means for different widths and spacing of said chords.

14. Truss assembly apparatus as set forth in claim 9 including track means for guiding and accurately locating said chords from said auxiliary roller means relative to said side roller means.

15. Truss assembly apparatus as set forth in claim 7 including sizing roller means for engaging the inside surface of said rectangular chords.

16. Truss assembly apparatus as set forth in claim 7 including sizing roller means for engaging both the inside and outside surfaces of and locating said chord means as they enter between said side roller means.

17. Truss assembly apparatus as set forth in claim 10 including side engaging roller means for an upper rectangular chord assembled with its major dimension in the plane of said truss, and guide means for engaging the outer surfaces of said chords for limiting their final spacing at the assembly location, said last named side engaging roller means being canted from a vertical axis to urge said upper chord into engagement with the upper chord space limiting means.

18. A production method for assembling trusses constructed of spaced parallel wood chords connected by stamped sheet metal elements having toothed extremities fixedly penetrating said wood chords comprising the steps of prepositioning said chords in parallel vertically spaced relation, positioning the extremities of said elements on respective horizontally spaced sides of said wood chords in required spaced relation to each other, driving and guiding said chords along a horizontal path, and applying synchronized compressive rolling pressure adjusted to the width of said chords to progressively force said toothed extremities into penetrating assembled relation along the length of said wood chords.

19. The method of claim 18 including the preassembly of wood joist frames having upper and lower chords joined by end and intermediate spacers.

20. The method of claim 19 including manual placement of stamped sheet metal V-web elements on either side of the spaced wood chords preparatory to and during compressive rolling of the next preceding V-webs.

21. The method of claim 20 including the manual placement of said V-web elements in end abutting relation with the next preceding pair during said compressive rolling.

22. The method of claim 20 with said wood chords held in vertical spaced relation adjacent said compressive rolling.

23. The method of claim 22 wherein said compressive rolling is effected with said wood chords moving in a substantially horizontal direction.

24. The method of claim 23 including the camber arching of said wood chords during said compressive rolling.

25. The method of claim 24 with said arching imposed while said wood chords are in upside down relation relative to their orientation in a building structure.

26. The method of claim 18 adjustably applied to rectangular wood chords oriented in opposed edge relation or opposed flat relation.

27. The method of claim 18 adjustably applied to different height and length requirements for different size V-webs.

28. The method of claim 18 adjustably applied to rectangular wood chords having different widths.

29. The method of any of claims 18–28 adjustably applied to rectangular wood chords of different width in either opposed edge or flat relation and to different spacing with different size V-webs.

30. The method of claim 21 with occasional manual placement of opposed V-webs in non-contiguous spaced relation with the next preceding V-webs to accommodate a lateral through opening for predetermined architectural end use requirements.

31. Truss assembly apparatus as set forth in claim 2 including exit track means providing an angular relationship relative to said roller means to effect a camber deflection to the finished truss.

32. Truss assembly apparatus as set forth in claim 31 wherein said angular relationship comprises a rising ramp angle to effect an arching of the chords as assembled in an upside down condition relative to their use as joists supported at their ends.

33. Truss assembly apparatus as set forth in claim 6 including space limiting means for engaging the upper surface of the upper chord, and upper chord side engaging roller means canted from a vertical axis to urge said upper chord into engagement with said upper chord space limiting means.

34. Truss assembly apparatus as set forth in claim 7 including spacer and sizing roller means for engaging the inside surface of the upper chord.

* * * * *